United States Patent [19]

Binversie et al.

[11] Patent Number: 5,049,101

[45] Date of Patent: Sep. 17, 1991

[54] MARINE PROPULSION DEVICE WITH ARRANGEMENT FOR FLUSHING ENGINE COOLING JACKET

[75] Inventors: Gregory J. Binversie, Grayslake; George L. Broughton, Zion; Robert L. Turk, Waukegan, all of Ill.

[73] Assignee: Outboard Marine Corporation, Waukegan, Ill.

[21] Appl. No.: 479,936

[22] Filed: Feb. 14, 1990

Related U.S. Application Data

[63] Continuation-in-part of Ser. No. 372,704, Jun. 26, 1989, abandoned.

[51] Int. Cl.[5] ..... B63H 21/10

[52] U.S. Cl. ..... 440/88

[58] Field of Search ..... 440/88, 89, 113; 134/167 R, 169 A

[56] References Cited

U.S. PATENT DOCUMENTS

| | | | |
|---|---|---|---|
| 3,002,488 | 10/1961 | Guhlin | 440/113 |
| 3,003,456 | 10/1961 | Crozier | 440/88 |
| 3,409,218 | 11/1968 | Moyer | 134/169 A |
| 3,550,612 | 12/1970 | Maxon | 137/112 |
| 4,108,190 | 8/1978 | Carlson | 134/167 R |
| 4,229,393 | 8/1988 | Ferguson | 134/167 R |
| 4,403,972 | 9/1983 | Bland et al. | 440/88 |
| 4,619,618 | 10/1986 | Patti | 440/88 |

FOREIGN PATENT DOCUMENTS

| | | | |
|---|---|---|---|
| 17198 | 1/1988 | Japan | 440/88 |

OTHER PUBLICATIONS

Tohatsu Outboard Motor Owner's Handbook.
Yamaha Outboard Motor Owner's Manual.
Suzuki Outboard Motor Owner's Manual.
FIG. 10-A Transmission Water Pump.

*Primary Examiner*—Jesus D. Sotelo
*Attorney, Agent, or Firm*—Michael, Best & Friedrich

[57] ABSTRACT

A marine propulsion device comprising a bracket structure adapted for connection to a boat transom and a propulsion unit connected to the bracket structure for pivotal movement about a generally vertical steering axis and for tilting movement about a generally horizontal tilt axis, which propulsion unit includes an internal combustion engine including an engine block having a cooling jacket, a lower unit supporting the engine block and including a propeller shaft drivingly connected to the engine, a cover removably supported by the propulsion unit in enclosing relation to the engine and including a portion having therein an opening, a conduit extending from the engine block and through the opening and including therein a bore communicating with the cooling jacket and having an outer end with an internal thread, and a plug removably and threadably received in the threaded outer end portion of the conduit.

24 Claims, 1 Drawing Sheet

MARINE PROPULSION DEVICE WITH ARRANGEMENT FOR FLUSHING ENGINE COOLING JACKET

RELATED APPLICATION

This is a continuation-in-part of Ser. No. 372,704, filed June 26, 1989, and now abandoned.

BACKGROUND OF THE INVENTION

1. Field of the Invention

The invention relates generally to marine propulsion devices and to internal combustion engines therefor. Still more particularly, the invention relates to internal combustion engines having cooling jackets and to arrangements for flushing such cooling jackets.

A typical outboard motor includes water intakes in the lower unit, a coolant supply conduit communicating between the water intakes and the engine cooling jacket, and a pump for pumping water through the coolant supply conduit to the engine cooling jacket.

A known method for flushing the engine cooling jacket is to provide a "cuff." See, for example, U.S. Pat. No. 4,052,953, which is assigned to the assignee hereof. More particularly, cups are placed over the water intakes and water is supplied to the cups by suitable means such as a garden hose. The engine is then started and the water pump draws the water in the cups into the water intakes and pumps the water to the engine cooling jacket.

2. Reference to Prior Art

Attention is directed to the following U.S. Pat. Nos.:

| | | |
|---|---|---|
| 2,611,631 | Benson | September 23, 1952 |
| 3,002,488 | Guhlin | October 3, 1961 |
| 3,003,456 | H. D. Crozier | October 10, 1961 |
| 3,550,612 | L. J. Maxon | December 29, 1970 |
| 3,931,828 | Lawler | January 13, 1976 |
| 4,108,190 | G. R. Carlson | August 22, 1978 |
| 4,619,618 | W. Patti | October 28, 1986 |
| 4,729,393 | J. A. Ferguson | March 8, 1988 |

SUMMARY OF THE INVENTION

The invention provides a marine propulsion device comprising bracket means adapted for connection to a boat transom and a propulsion unit connected to the bracket means for pivotal movement about a generally vertical steering axis and for tilting movement about a generally horizontal tilt axis, which propulsion unit includes an internal combustion engine including an engine block having a cooling jacket, a lower unit supporting the engine block and including a propeller shaft drivingly connected to the engine, a cover removably supported by the propulsion unit in enclosing relation to the engine and including a portion having therein an opening, and a conduit extending from the engine block and through the opening and including therein a bore communicating with said cooling jacket and having an outer end located exteriorly of the cover.

In one embodiment of the invention the marine propulsion device further includes valve means in the bore for permitting inflow to the cooling jacket and for preventing outflow from the cooling jacket.

The invention also provides a marine propulsion device comprising bracket means adapted for connection to a boat transom and a propulsion unit connected to the bracket means for pivotal movement about a generally vertical steering axis and for tilting movement about a generally horizontal tilt axis, which propulsion unit includes an internal combustion engine including an engine block having a cooling jacket, a lower unit supporting the engine block and including a propeller shaft drivingly connected to the engine, a cover removably supported by said propulsion unit in enclosing relation to the engine and including a portion having therein an opening, a conduit extending from the engine block and through the opening and including therein a bore communicating with the cooling jacket and having an outer end with an internal thread, and a plug removably and threadably received in the threaded outer end portion of the conduit.

The invention also provides an internal combustion engine including an engine block having a cooling jacket, a conduit extending from the engine block and including a bore communicating with the cooling jacket and having an end portion with an internal thread, and a plug threadably and removably received in the end portion.

The invention also provides an internal combustion engine including an engine block having a cooling jacket, a conduit extending from the engine block and including a bore communicating with the cooling jacket, and valve means in the bore for permitting inflow to the cooling jacket and for preventing outflow from the cooling jacket.

The invention also provides an internal combustion engine including an engine block having a cooling jacket, a conduit extending from the engine block and including a bore communicating with the cooling jacket and having an end portion with an internal thread, a plug threadably and removably received in the end portion and including a restricted opening extending axially thereof and an outer end having therein a recess for receipt of a tool for rotating the plug relative to the conduit, and valve means in the bore for permitting inflow to the cooling jacket and for preventing outflow from the cooling jacket.

The invention also provides an outboard motor comprising bracket means adapted for connection to a boat transom and a propulsion unit connected to the bracket means for pivotal movement relative thereto, the propulsion unit including an internal combustion engine comprising an engine block including a cooling jacket, a lower unit supporting the engine block and including a propeller shaft driven by the engine, and means for supplying pressurized coolant to the cooling jacket without operating the engine.

The invention also provides an outboard motor comprising bracket means adapted for connection to a boat transom and a propulsion unit connected to the bracket means for pivotal movement relative thereto, the propulsion unit including an internal combustion engine comprising an engine block including a cooling jacket, a lower unit supporting the engine block and including a propeller shaft driven by the engine, a pump for supplying coolant to the cooling jacket during normal operation of the outboard motor, and means for supplying pressurized coolant to the cooling jacket, the means including means for attaching and detaching a common garden hose at a location downstream of the pump.

A principal feature of the invention is the provision of an arrangement for using pressurized water to flush the cooling jacket of the engine of a marine propulsion device without having to run the engine. The arrangement provided by the invention overcomes the disadvantages of cuffs. A cuff does not provide sufficiently pressurized water to pump water through the water pump and through the engine cooling jacket without running the engine. This can be inconvenient in areas where noise is undesirable, as outboard motor engines are quite loud out of the water. Also, when an outboard motor engine is flushed "on the water," a cuff can be difficult to place on the lower unit because the lower unit is out over the water. Cuffs also have a tendency to fall off during use. Furthermore, a cuff is inconvenient because it is not built into the outboard motor.

Other features and advantages of the invention will become apparent to those skilled in the art upon review of the following detailed description, claims, and drawings.

THE DRAWINGS

Figure 1:
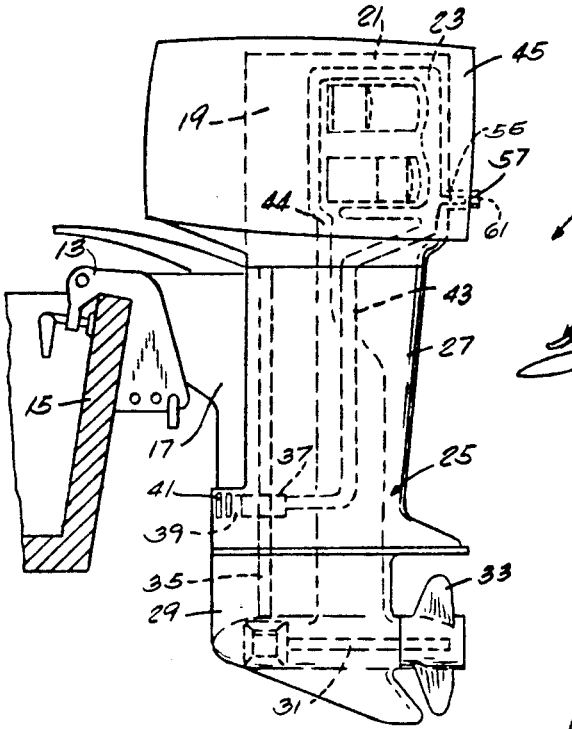
FIG. 1 is a side elevational view, partially in section, of a boat mounted marine propulsion device incorporating various of the features of the invention.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown the drawings is a marine propulsion device in the form of an outboard motor 11 including bracket means 13 adapted to be attached to a boat transom 15 and a propulsion unit 17 connected to the bracket means 15 for a pivotal movement about a generally vertically steering axis and about a generally horizontal tilting axis.

Figure 3:
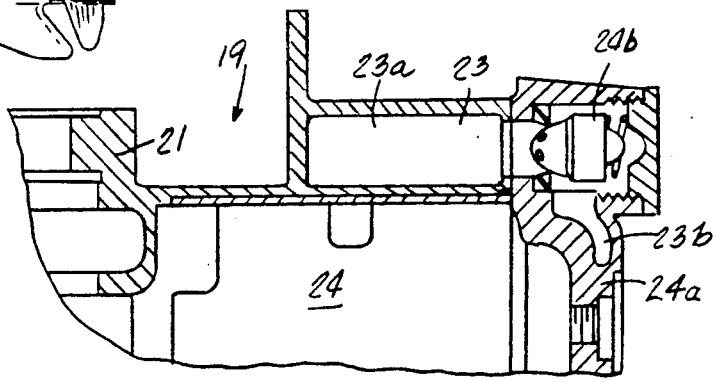
FIG. 3 is a partial sectional view of the engine of the marine propulsion device.

The propulsion unit 17 includes an internal combustion engine 19 comprising an engine block 21 defining an interior cooling jacket 23. Any suitable engine construction can be employed. In the preferred embodiment, the engine 19 also comprises (see FIG. 3) a plurality of cylinders 24 and a cylinder head **24*a*. The cooling jacket 23 preferably includes an upstream portion 23*a* surrounding the cylinders 24 and a downstream portion 23*b* within the cylinder head 24*a*. The engine 19 preferably further comprises valve means 24*b* for permitting communication between the upstream and downstream cooling jacket portions 23*a* and 23*b* when the coolant temperature in the upstream portion 23*a* is above a predetermined temperature or when the coolant pressure in the upstream portion 23*a* is above a predetermined pressure and for substantially preventing communication between the upstream and downstream portions 23*a* and 23*b* when the coolant temperature in the upstream portion 23*a* is below the predetermined temperature and the coolant pressure in the upstream portion 23*a*** is below the predetermined pressure. Such valve means is known in the art and will not be described in further detail.

The propulsion unit 17 also includes a lower unit 25 comprising a drive shaft housing 27 which, at its upper end, supports the engine block 21, and which, at its lower end, has attached thereto a gear case 29 which rotatably supports a propeller shaft 31 having mounted thereon a propeller 33. The propeller shaft 31 is drivingly connected to the engine 19 via a drive shaft 35 rotatably supported in the drive shaft housing 27.

The propulsion unit 17 also includes a pump 37 for supplying coolant to the engine cooling jacket 23. Any suitable pump, preferably driven by the drive shaft 35, can be employed.

Figure 2:
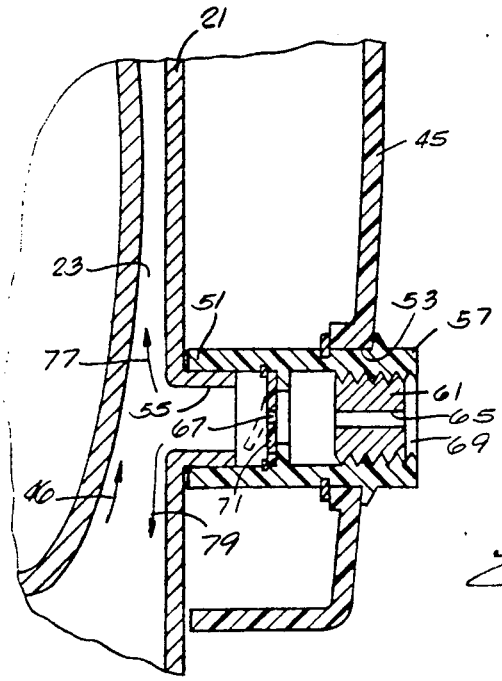
FIG. 2 is an enlarged fragmentary view of a portion of the marine propulsion device shown in FIG. 1.

The pump 37 communicates with an inlet conduit 39 leading to a water intake 41 in the lower unit 25. In addition, a coolant supply conduit 43 extends from the pump 37 to the cooling jacket 23 to supply coolant to the cooling jacket 23 in response to drive shaft rotation. Normal coolant flow from the pump 37 to the cooling jacket 23 is indicated in FIG. 2 by an arrow 46.

Extending from the cooling jacket 23 and shown schematically is a conduit 44 for discharging coolant from the cooling jacket 23. Any suitable construction can be employed.

Supported by the propulsion unit 17, and in enclosing relation to the engine 19, is a cover or cowl 45. Any suitable cowl construction can be employed.

As thus far described, the construction is conventional.

The propulsion unit 17 also includes means facilitating flushing of the cooling jacket 23 and including means for readily attaching and detaching the male end of a common garden hose so as to enable supply of flushing water to the cooling jacket 23.

More specifically, in this last regard, while other specific constructions can be employed, in the disclosed construction, such flushing means comprises a conduit 51 extending from the engine block 21 and through an opening 53 in the cowl or cover 45, which conduit 51 includes an internal passage 55 communicating with the cooling jacket 23 and having an outer end 57 which is provided with an internal thread adapted to receive the male end of a common garden hose.

Removably located in the outer end 57 of the internal passage 55 is a threaded plug 61 which, when threaded into the passage 55, closes the passage 55 to generally prevent the escape of coolant from the cooling jacket 23.

Preferably, the plug 61 includes means in the form of a relatively small axially extending restricted bore 65 for draining a restricted amount of coolant from the cooling jacket 23.

In addition, the plug 61 includes, on the outer surface thereof, a recess 69, such as a diametric slot, adapted for receipt of a tool, such as a screw driver, for effecting rotation of the plug 61 relative to the passage 55, and thereby to enable removal of the plug 61 from the passage 55 and to enable tightly seating the plug 61 in the passage 55 to prevent coolant flow from the cooling jacket 23 between the plug 61 and the passage 55.

It is particularly noted that passage of the conduit 51 through the opening 53 in the cover 45 enables flushing of the engine 19 without requiring removal of the cover 45. Of course, at least some of the advantages of the invention can be provided if the passage 55 terminates inside the cover 45, whereby the cover is removed to afford flushing of the engine 19.

Preferably, the passage 55 is also provided with means for preventing outflow of coolant from the cooling jacket 23 when the plug 61 is removed and for permitting inflow of water to the cooling jacket 23 when the plug 61 is removed. While various other constructions can be employed, such as a ball check valve, in the disclosed construction, such means comprises a reed valve 71. If desired, the reed valve 71 can be provided with a small aperture 67 to afford limited coolant flow from the cooling jacket 23 and through the bore 65 to the exterior of the cover 45 so as to provide an overboard indicator or tell-tale.

In operation, when it is desired to flush the engine 19, the plug 61 is initially removed from the passage 55 in the conduit 51, and in place thereof, the male end of a common garden hose is threadably inserted. Turning on the supply of water to the garden hose will thus open the reed valve 71 and will effect flushing of the cooling jacket 23 of the engine 19. Thus, the flushing means also includes means for supplying coolant to the cooling jacket 23 without operating either the engine 19 or the pump 37, and means for attaching and detaching a common garden hose at a location downstream of the pump 37.

Water flow from the garden hose to the cooling jacket 23 is indicated in FIG. 2 by an arrow 77. Some water from the garden hose also flows "backward" through the conduit 43 to the water pump 37. This water is indicated in FIG. 2 by an arrow 79. The water pump 37 acts as a valve that is substantially, but not completely, closed. The pressure from the garden hose is sufficient to deflect the vanes in the water pump 37 so that a small amount of water flows through the water pump 37 and out the water inlet 41. The pressure from the garden hose is also sufficient to "blow off" or open the valve means **24*b*, so that most of the water supplied by the garden hose flows through the cooling jacket 23, flushes the cooling jacket 23 of salt water or debris, and is discharged through the normal outlet 44. Since some water is supplied to the water pump 37 during flushing, the engine 19 can be operated during flushing without damaging the water pump 37**.

When the flushing is completed, the male end of the common garden hose can be threadably removed from the conduit 51. During such removal, loss of fluid from the cooling jacket 23 is prevented by the reed valve 71. After the male end of the garden hose is removed, the plug 61 can be reinstated and tightened in order to prevent undue stress on the reed valve and, if provided with a restricted bore 65, to provide a tell-tale indicating that the pump is working. If the outboard motor 11 is operated before the plug 61 is replaced, the reed valve 71 prevents water supplied by the pump 37 from flowing out through the passage 55 before flowing through the engine cooling jacket 23.

Various of the features of the invention are set forth in the following claims.

We claim:

1. A marine propulsion device comprising bracket means adapted for connection to a boat transom and a propulsion unit connected to said bracket means for pivotal movement about a generally vertical steering axis and for tilting movement about a generally horizontal tilt axis, said propulsion unit including an internal combustion engine including an engine block having a cooling jacket, a lower unit supporting said engine block and including a propeller shaft driven by said engine, a cover removably supported by said propulsion unit in enclosing relation to said engine and including a portion having therein an opening, a conduit extending from said engine block and through said opening and including therein a bore communicating with said cooling jacket and having an outer end exteriorly of said cover, and valve means in said bore for permitting inflow to said cooling jacket and for preventing outflow from said cooling jacket.

2. A marine propulsion device in accordance with claim 1 wherein said outer end includes an internal thread, and further including a plug removably and threadably received in said threaded outer end of said conduit.

3. A marine propulsion device in accordance with claim 1 wherein said valve means comprises a reed valve.

4. A marine propulsion device comprising bracket means adapted for connection to a boat transom and a propulsion unit connected to said bracket means for pivotal movement about a generally vertical steering axis and for tilting movement about a generally horizontal tilt axis, said propulsion unit including an internal combustion engine including an engine block having a cooling jacket, a lower unit supporting said engine block and including a propeller shaft driven by said engine, a cover removably supported by said propulsion unit in enclosing relation to said engine and including a portion having therein an opening, a conduit extending from said engine block and through said opening and including therein a bore communicating with said cooling jacket and having an outer end with an internal thread, and a plug removably and threadably received in said threaded outer end of said conduit.

5. A marine propulsion device in accordance with claim 4 wherein said plug includes a restricted opening extending axially thereof.

6. A marine propulsion device in accordance with claim 5 wherein said plug includes an outer end having therein a recess for receipt of a tool for rotating said plug relative to said conduit.

7. A marine propulsion device in accordance with claim 5 and further including valve means in said bore for permitting inflow to said cooling jacket and for preventing outflow from said cooling jacket.

8. A marine propulsion device in accordance with claim 7 wherein said valve means comprises a reed valve.

9. An internal combustion engine including an engine block having a cooling jacket, a conduit extending from said engine block and including a bore communicating with said cooling jacket, and valve means in said bore for permitting inflow to said cooling jacket and for substantially preventing outflow to said cooling jacket while affording limited flow from said cooing jacket so as to provide a tell-tale.

10. An internal combustion engine in accordance with claim 9 wherein said valve means comprises a reed valve.

11. An internal combustion engine according to claim 9 wherein said conduit has an end portion with an internal thread, and wherein said conduit further comprises a plug threadably and removably received in said end portion.

12. An internal combustion engine in accordance with claim 11 wherein said plug includes a restricted opening extending axially thereof, and wherein said valve means affords limited flow through said restricted opening.

13. An internal combustion engine in accordance with claim 11 wherein said plug includes an outer end having therein a recess for receipt of a tool for rotating said plug relative to said conduit.

14. An internal combustion engine including an engine block having a cooling jacket, a conduit extending from said engine block and including a bore communicating with said cooling jacket and having an end portion with an internal thread, a plug threadably and removably received in said end portion and including a restricted opening extending axially thereof and an outer end having therein a recess for receipt of a tool for rotating said plug relative to said conduit, and valve means in said bore for permitting inflow to said cooling jacket and for substantially preventing outflow form said cooling jacket while affording limited flow from said cooling jacket and through said restricted opening so as to provide a tell-tale.

15. An internal combustion engine in accordance with claim 14 wherein said valve means comprises a reed valve.

16. An outboard motor comprising bracket means adapted for connection to a boat transom and a propulsion unit connected to said bracket means for pivotal movement relative thereto, said propulsion unit including an internal combustion engine comprising an engine block including a cooling jacket, a lower unit supporting said engine block and including a propeller shaft driven by said engine, a pump for supplying coolant to said cooling jacket during normal operation of said outboard motor, and means for supplying pressurized coolant to said cooling jacket without operating said engine and such that said pressurized coolant bypasses said pump.

17. An outboard motor as set forth in claim 16 wherein said pump is driven by said engine.

18. An outboard motor as set fort in claim 16 wherein said supplying means includes means for attaching and detaching a common garden hose so as to enable supply of flushing water to said cooling jacket.

19. An outboard motor comprising bracket means adapted for connection to a boat transom and a propulsion unit connected to said bracket means for pivotal movement relative thereto, said propulsion unit including an internal combustion engine comprising an engine block including a cooling jacket, a lower unit supporting said engine block and including a propeller shaft driven by said engine, a pump for supplying coolant to said cooling jacket during normal operation of said outboard motor, and means for supplying pressurized coolant to said cooling jacket, said supplying means including means for attaching and detaching a common garden hose at a location downstream of said pump.

20. An outboard motor as set forth in claim 19 wherein said pump is driven by said engine.

21. A marine propulsion device comprising bracket means adapted for connection to a boat transom and a propulsion unit connected to said bracket means for pivotal movement about a generally vertical steering axis and for tilting movement about a generally horizontal tilt axis, said propulsion unit including an internal combustion engine including an engine block having a cooling jacket, a lower unit supporting said engine block and including a propeller shaft driven by said engine, and a conduit extending from said engine block and including therein a bore communicating with said cooling jacket, and said conduit having an outer end located exteriorly of said lower unit and adapted to communicate with a source of coolant for flushing.

22. A marine propulsion device comprising bracket means adapted for connection to a boat transom and a propulsion unit connected to said bracket means for pivotal movement about a generally vertical steering axis and for tilting movement about a generally horizontal tilt axis, said propulsion unit including an internal combustion engine including an engine block having a cooling jacket, a lower unit supporting said engine block and including a propeller shaft driven by said engine, a coolant pump driven by said engine and communicating with said cooling jacket, and a conduit extending from said engine block and including therein a bore communicating with said cooling jacket independently of said coolant pump, and said conduit having an outer end located exteriorly of said lower unit and adapted to communicate with a source of coolant for flushing.

23. A marine propulsion device comprising bracket means adapted for connection to a boat transom and a propulsion unit connected to said bracket means for pivotal movement about a generally vertical steering axis and for tilting movement about a generally horizontal tilt axis, said propulsion unit including an internal combustion engine including an engine block having a cooling jacket, a lower unit supporting said engine block and including a propeller shaft drivingly connected to said engine, a conduit extending from said engine block and including therein a bore communicating with said cooling jacket and having an outer end with an internal thread, and a plug removably and threadably received in said threaded outer end of said conduit.

24. A marine propulsion device comprising bracket means adapted for connection to a boat transom and a propulsion unit connected to said bracket means for pivotal movement about a generally vertical steering axis and for tilting movement about a generally horizontal tilt axis, said propulsion unit including an internal combustion engine including an engine block having a cooling jacket, a lower unit supporting said engine block and including a propeller shaft drivingly connected to said engine, a coolant pump drivingly connected to said engine and communicating with said cooling jacket, a conduit extending from said engine block and including therein a bore communicating with said cooling jacket independent of said coolant pump and having an outer end with an internal thread, and a plug removably and threadably received in said threaded outer end of said conduit.

* * * * *